US008511771B2

(12) United States Patent
Humet et al.

(10) Patent No.: US 8,511,771 B2
(45) Date of Patent: Aug. 20, 2013

(54) PRINTING SYSTEM

(75) Inventors: Jacint Humet, Barcelona (ES); Marc Serra, Barcelona (ES); Jaime Ferandez, Barcelona (ES); Eduardo Amela Conesa, Lleida (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 73 days.

(21) Appl. No.: 13/159,994

(22) Filed: Jun. 14, 2011

(65) Prior Publication Data

US 2012/0320116 A1 Dec. 20, 2012

(51) Int. Cl.
*B41J 25/308* (2006.01)

(52) U.S. Cl.
USPC ..... 347/8

(58) Field of Classification Search
CPC ..... B41J 11/002; B41J 11/007
USPC ..... 347/5, 8, 9, 40
See application file for complete search history.

(56) References Cited

U.S. PATENT DOCUMENTS

| | | | | |
|---|---|---|---|---|
| 5,012,257 | A | 4/1991 | Lowe et al. | |
| 6,244,688 | B1 | 6/2001 | Hickman | |
| 6,254,217 | B1 | 7/2001 | Askeland et al. | |
| 6,270,214 | B1 | 8/2001 | Smith et al. | |
| 6,299,287 | B1 | 10/2001 | Williams et al. | |
| 6,406,127 | B1 | 6/2002 | Mandel | |
| 6,412,935 | B1 | 7/2002 | Doumaux | |
| 6,561,610 | B2 | 5/2003 | Yamasaki et al. | |
| 7,036,904 | B2 * | 5/2006 | King et al. | 347/19 |
| 7,510,252 | B2 | 3/2009 | Conca et al. | |
| 7,530,683 | B2 | 5/2009 | Bauer | |
| 2002/0001013 | A1 | 1/2002 | Richtmeier et al. | |
| 2003/0058295 | A1 | 3/2003 | Heiles et al. | |
| 2008/0100669 | A1 | 5/2008 | Ciere et al. | |
| 2010/0288163 | A1 | 11/2010 | Valentini | |
| 2010/0293725 | A1 | 11/2010 | Hermann | |

FOREIGN PATENT DOCUMENTS

| | | |
|---|---|---|
| JP | 2007069378 | 3/2007 |

* cited by examiner

*Primary Examiner* — An Do

(57) ABSTRACT

A printing system includes first and second printheads spaced apart so as to define a gap between the first and second printheads. A controller is configured to the control printheads, including establishing a swath height based on the gap.

15 Claims, 3 Drawing Sheets

PRINTING SYSTEM

BACKGROUND

An ink jet printer forms a printed image by printing a pattern of individual dots at particular locations of an array defined for the printing medium. The locations are conveniently visualized as being small dots in a rectilinear array. The locations are sometimes dot locations, dot positions, or pixels. Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times corresponding to the pattern of pixels of the image being printed. The print medium is typically held stationary while the printheads complete a "print swath." The print medium is then advanced and the carriage again moves across the print medium to print on the next portion of the medium.

Color ink jet printers commonly employ a plurality of printheads mounted in the print carriage to produce different colors. Each printhead contains ink of a different color, with commonly used colors including cyan, magenta, yellow, and black. These base colors are produced by depositing a drop of the required color onto a dot location. Secondary or shaded colors are formed by depositing drops of different colors on adjacent dot locations; the human eye interprets the color mixing as the secondary or shading, through well known optical principles.

Some ink jet printers use a fixer fluid, depending on the type of inks or the print medium being used, for example. Fixer fluids can be used to pretreat the print medium, causing the subsequently applied colored ink droplets to precipitate quickly. In still other ink jet printers, an overcoat fixer fluid is applied during the printing process after the colored inks have been applied to the print media. In such printers, one or more additional printheads are provided for depositing the fixer fluid.

DETAILED DESCRIPTION

In the following detailed description, reference is made to the accompanying drawings which form a part hereof, and in which is shown by way of illustration specific implementations in which the invention may be practiced. In this regard, directional terminology, such as "top," "bottom," "front," "back," "leading," "trailing," etc., is used with reference to the orientation of the Figure(s) being described. Because disclosed components can be positioned in a number of different orientations, the directional terminology is used for purposes of illustration and is in no way limiting. It is to be understood that other implementations may be utilized and structural or logical changes may be made without departing from the scope of the present invention. The following detailed description, therefore, is not to be taken in a limiting sense, and the scope of the present invention is defined by the appended claims.

Figure 1:
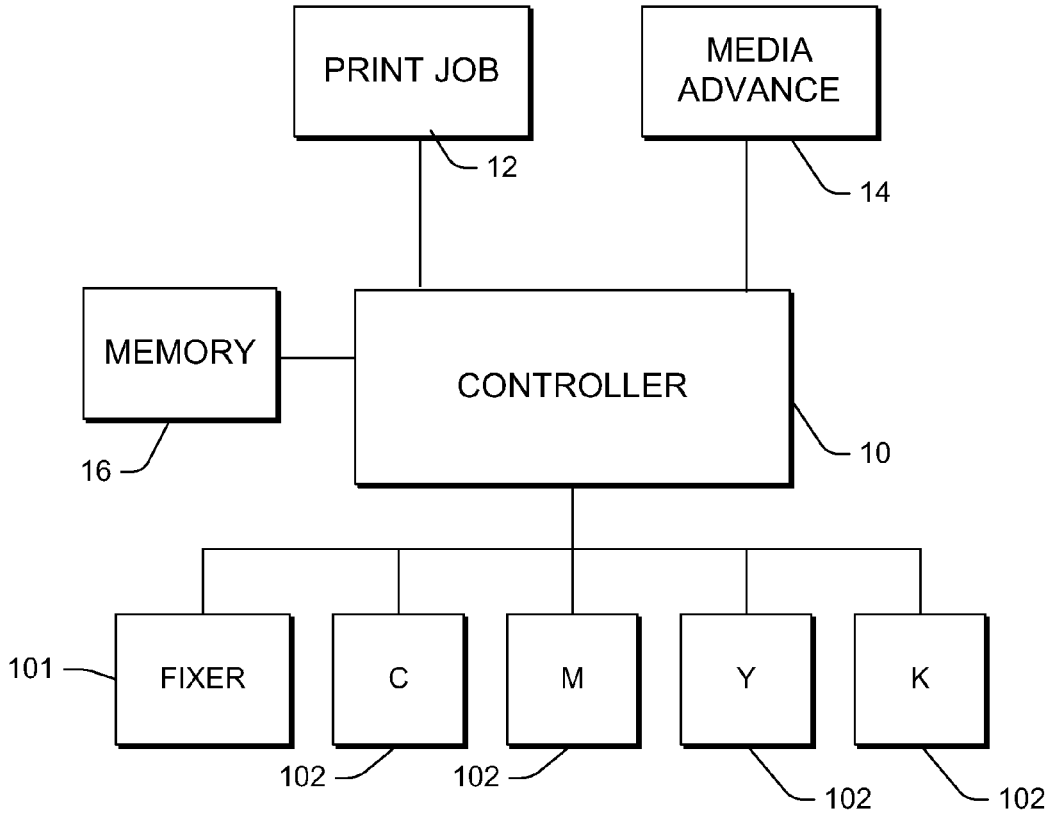
FIG. 1 is a block diagram conceptually illustrating an example of a printer system.

FIG. 1 is block diagram illustrating aspects of an example printing system. A controller 10 receives print job commands and data from a print job source 12, which can be a computer system or other source of print jobs. The controller 10 acts on the received commands to provide control signals to a media advance device 14 to advance a print medium such as a sheet of paper to a print zone where it receives ink to create an image. As the print medium is advanced, firing pulses are sent to a plurality of printheads, or pens in response to control signals received from the controller. The illustrated example has five printheads, which include a fixer fluid printhead 101 and a plurality of color ink printheads 102. In the illustrated implementation, the color printheads include cyan (C), magenta (M), yellow (Y) and black (K) ink printheads.

The controller 10 may be implemented by one or more discrete modules (or data processing components) that are not limited to any particular hardware, firmware, or software configuration. The controller 10 may be implemented in any computing or data processing environment, including in digital electronic circuitry (e.g., an application-specific integrated circuit, such as a digital signal processor (DSP)) or in computer hardware, firmware, device driver, or software. In some implementations, the functionalities of the modules are combined into a single data processing component. In some examples, the respective functionalities of each of one or more of the modules are performed by a respective set of multiple data processing components.

In some implementations, process instructions (e.g., machine-readable code, such as computer software) for implementing the methods that are executed by the controller 10, as well as the data it generates, are stored in a memory device 16 accessible by the controller 10. The memory device 16 may include one or more tangible machine-readable storage media. Memory devices 16 suitable for embodying these instructions and data include all forms of computer-readable memory, including, for example, semiconductor memory devices, such as EPROM, EEPROM, and flash memory devices, magnetic disks such as internal hard disks and removable hard disks, magneto-optical disks, DVD-ROM/RAM, and CD-ROM/RAM.

Figure 2:
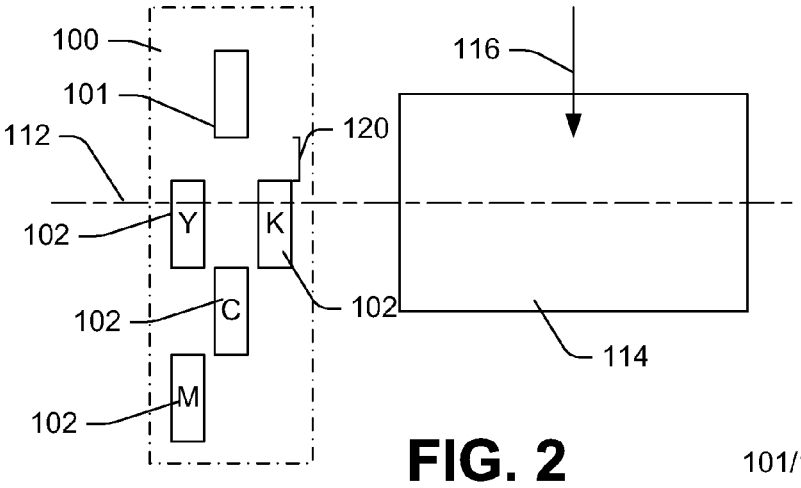
FIG. 2 is a block diagram conceptually illustrating further aspects of the system illustrated in FIG. 1.

Some printhead arrangements use linear arrays of print elements, wherein the pens of different colors are situated one next to the other. Other arrangements use a staggered configuration where the color ink printheads are staggered to improve image quality by reducing ink flux per area of print media. FIG. 2 conceptually illustrates such a staggered printhead arrangement. In this diagrammatic view, a printer carriage 100 moves along a swath axis 112 over a print zone 114 of a print medium. As illustrated in FIG. 2, the swath axis 112 is horizontal, and the print medium moves on an axis perpendicular to the swath axis 112 (up and down in FIG. 2), with the media advance direction indicated by an arrow 116. The carriage 100 supports the pens 101,102 situated in a staggered arrangement wherein each of the non-black-ink pens do not overlap in the scan direction over the print zone 114. Further, the fixer pen 101 is spaced apart from the first (uppermost) color pen 102 in the direction of the media advance axis to form a gap 120. The provision of the gap 120 between the fixer pen 101 and the color pens 102 avoids cross-contamination among inks. For example, some printing systems include an automatic servicing routine where the printhead nozzles are cleaned by using a wet cloth that wipes the nozzles. Providing the gap 120 between the fixer pen 101 and the adjacent color pen 102 avoids cross-contamination during a process such as this.

Figure 3:
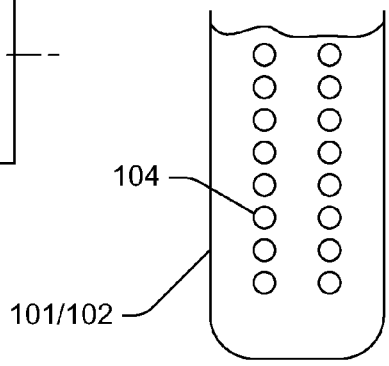
FIG. 3 is a schematic view conceptually illustrating a portion of an example of a printhead.

Each of the printheads 101, 102 includes a plurality of nozzles through which the fixer fluid and ink are ejected. The nozzles are typically arranged in one or more arrays extending in the media advance direction. FIG. 3 conceptually illustrates a portion of an example printhead having a nozzle array including two columns of nozzles 104. The length of the nozzle array defines the maximum pattern of ink that can be laid down on the media in a single pass, with the total span of the nozzle arrays defining the maximum swath height. A printer such as that disclosed herein can operate according to several different print modes. For example, in a single-pass print mode, after each printing pass the media is advanced a distance equal to the full span of the nozzle array, such that each pass forms a complete strip of the image on the print medium. In a multi-pass print mode, the media only advances a fraction of the total length of the nozzle array after each printing pass of the printheads, and each strip of the image to be printed is formed in successive passes of the printheads. Further, printing can be unidirectional where the printheads only print when travelling in one direction along the scan axis, or it can be bidirectional where the printheads print when travelling in a "forward pass" and also when travelling in a "return pass," the print medium being advanced after each pass.

The printhead arrangement of FIG. 2 supports bidirectional swath printing without resulting in undesirable hue-shifting from a swath in a first direction and a swath in the opposite direction among the fully staggered printheads. As the print medium is advanced in the advance direction 116, the leading edge of the print zone 114 first encounters the fixer pen 101. A first pass of the carriage 100 over the print zone in a first direction, left-to-right for example, will use only the fixer pen 101 to lay down fixer fluid along the coverage area of its nozzle array. After the first pass, the medium is incrementally advanced by an advance distance. A fresh area of the print medium is now positioned below the fixer pen, and the area to which the fixer fluid was applied is now below one or more of the color ink pens 102.

For the second pass of the carriage 100 in the reverse direction, (right-to-left in this example), the fixer pen 101 and the appropriate color ink pen(s) 102 are driven to apply drops of the corresponding fluid. Upon completion of the second pass, the medium is advanced by the same incremental distance, such that a fresh medium area is again below the fixer pen 101, the second area just traversed by the fixer pen 101 during the second pass is below the color ink pen 102, and the area to which both fixer and colored ink have been applied is now below another color ink pen 102. The carriage 100 again traverses the print zone 114 with the fixer pen 101 and appropriate color ink pens 102 driven to apply the corresponding fluid, and so on. For the subsequent passes over the print zone 114 until the end of the page or print job is approached, all of the color ink pens 102 driven by the controller 102 to achieve the desired color image.

FIG. 4 illustrates a typical printing arrangement for a printer using a carriage 100 and printheads 101, 102 in accordance with FIG. 2. The printing system illustrated in FIG. 4 commonly uses a six-pass print mode, so the physical gap 120 between the fixer pen 101 and the color printheads 102 is ⅙ of the nozzle array height of the color ink printheads 102, or 1.4 inches. For simplicity, the six-pass print mode upon which the physical gap 120 is based in the illustrated example is referred to as the "typical print mode." Even though the physical gap 120 is determined based on the typical print mode, the printer may be required to print using other print modes having more or fewer passes in some instances. FIG. 4 illustrates a situation where the printer is operating in a two-pass mode, rather than its typical six-pass print mode. The non-typical print mode used in the illustrated examples is referred to herein as the "current print mode."

Figure 4A:
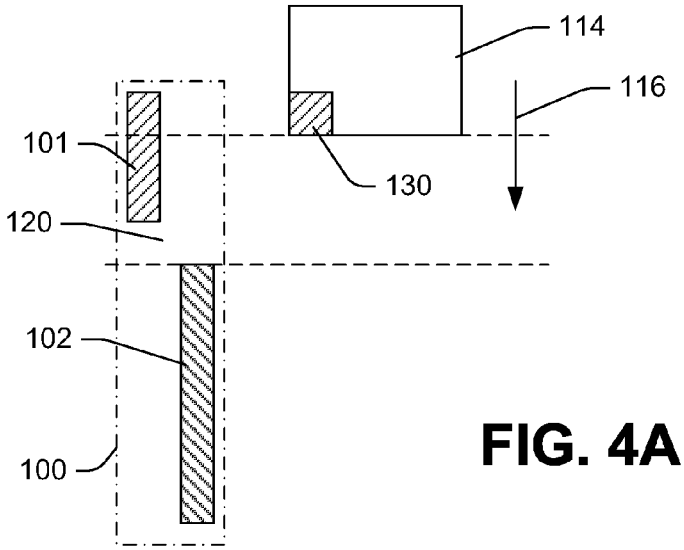
FIGS. 4A, 4B and 4C illustrate an example of a printing process.
Figure 4B:
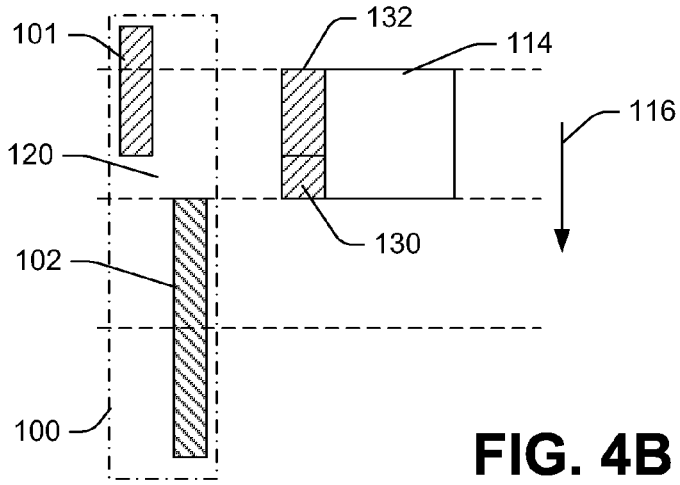
Figure 4C:
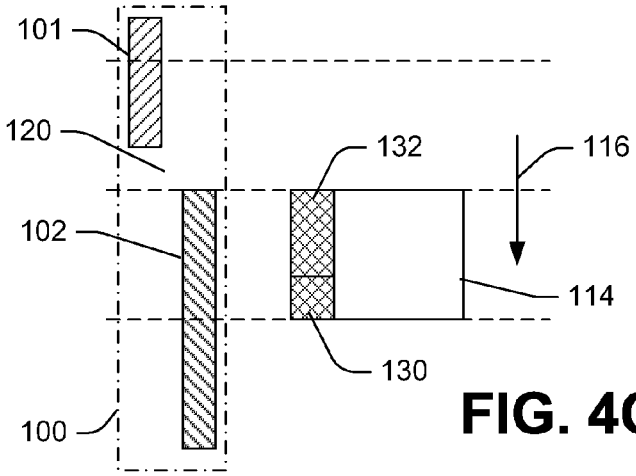

The color printheads 102 have a total swath of 8.4 inches, with the printheads 102 having an array of 10,080 nozzles. As used in this disclosure, swath height refers to the total height of printhead nozzle array (the vertical length of the printheads 102 as illustrated in FIGS. 4 and 5). The fixer printhead 101 has 5,040 nozzles 104 in an array extending 4.2 inches. The current print mode (two-pass) in the implementation illustrated in FIG. 4 has an advance distance of 4.2 inches, or half the swath height of the color printheads 102. In the example of FIG. 4, the fixer fluid 101 is a pretreatment fluid and thus is applied to the print media before the color ink 102. FIG. 4A illustrates the first pass of the carriage 100 across the print zone 114. Because of the gap 120, during the first pass the fixer fluid is applied by the printhead 101 to a first area 130 of the print zone 114. After the first pass, the print medium is advanced in the media advance direction indicated by the arrow 116 so that the print zone is positioned as illustrated in FIG. 4B. A second application of the fixer fluid is then applied to a second area 132 of the print zone 114. The first and second areas 130,132 of the print zone 114 are now pretreated and ready to receive the colored ink. The print zone 114 is advanced to the position indicated in FIG. 4C, and the colored ink is applied to the first and second areas 130,132 by the color printhead 102 in the next pass of the carriage 100 across the print zone 114. However, when the color ink is applied to the pretreated areas 130, 132 of the print zone 114, the ink applied to the first area 130 is laid on top of fixer fluid that was applied two passes prior, and the remaining color ink applied to the second area 132 is laid on top of fixer fluid applied during the immediately preceding pass. Since the fixer fluid is deposited during two different passes, it may not be laid uniformly across the swath. For instance, this could result in the fixer fluid pretreating an area of a single printing pass having different dry times, possibly resulting in changes in ink-fixer-media interactions.

FIG. 5 illustrates a two-pass current print mode implementation in which the swath height is adjusted based on the gap 120 so that the fixer fluid is applied uniformly during a single pass of the carriage 100. The physical arrangement of the carriage 100 and printheads 101, 102 illustrated in FIG. 5 is the same as that disclosed in conjunction with FIG. 4, so the physical gap 120 is ⅙ of the nozzle array height of the color ink printheads 102 based on the typical six-pass print mode for the printer in this example. The controller 10 controls which specific nozzles 104 of the printheads 101,102 are fired to eject fluid via a print mask. As used in this context, the term print mask refers to control data that determines which of the nozzles 104 of the various printheads 101,102 are fired at a given time to eject fluid as desired. In the example of FIG. 5, the print mask is set such that predetermined nozzles 104 positioned proximate the gap 120 are not used to deposit fixer fluid or ink. Thus, one of the fixer fluid printhead 101 or the ink printheads 102, or both the fixer fluid printhead 101 and the ink printheads 102, are masked such that certain nozzles adjacent the gap are not used. In this manner, the swath height is established based on the gap 120 for the particular current print mode.

For example, in the implementation illustrated in FIG. 5, 840 nozzles of the fixer fluid print head 101 adjacent the gap 120 (nozzles at the bottom of the printhead 101 as shown in FIG. 5) are not used. Additionally, 1,680 nozzles of the uppermost color ink printhead 102 adjacent the gap 120 (nozzles at the top of the printhead 102 as shown in FIG. 5) are not used. This reduces the total swath height to 7 inches with an advance distance of 3.5 inches. This effectively increases the gap 120 to 3.5 inches. In other words, the gap 120 together with the masked portions of the printheads 101, 102 define a larger effective gap between the printing portions of printheads 101, 102. Moreover, the printheads 101, 102 are masked to establish a swath height that is a full multiple of the effective gap, and the height of the fixer fluid printhead 101 matches the effective gap between the fixer fluid printhead 101 and the color ink printheads 102.

Figure 5A:
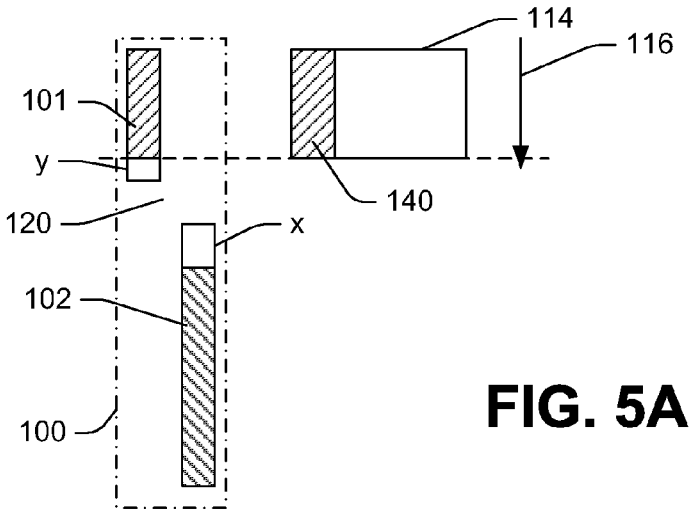
FIGS. 5A, 5B and 5C illustrate an example of another printing process.
Figure 5B:
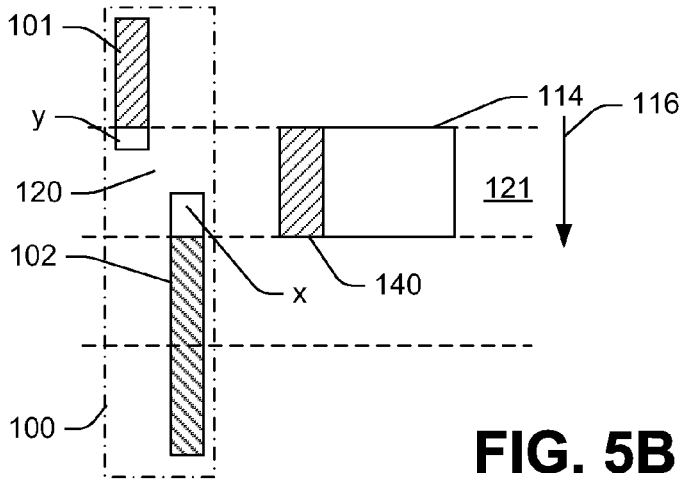
Figure 5C:
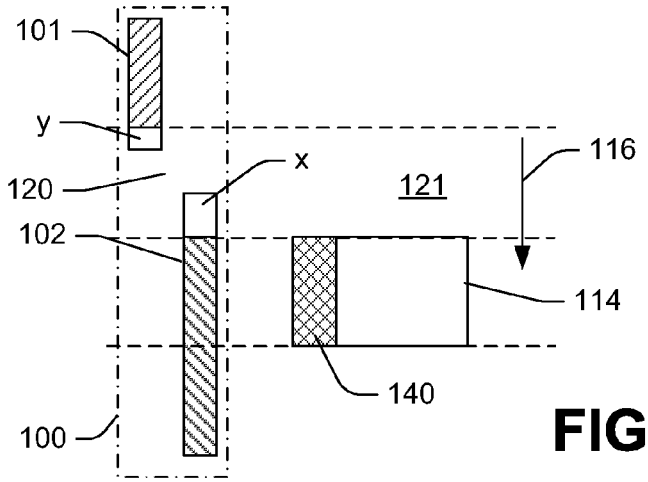

FIG. 5A illustrates the first pass of the carriage 100 across the print zone 114. Fixer fluid is applied by the fixer printhead 101 uniformly down the entire advance distance (3.5 inches in FIG. 5) to an area 140 during the first pass. The print medium is then advanced such that the print zone 114 is positioned within the gap 121 as shown in FIG. 5B. The area 140 of the print zone 114 does not receive fixer fluid or ink during the pass illustrated in FIG. 5B (the printheads 101, 102 typically would be applying fixer fluid and ink to other portions of the print medium during this pass). In FIG. 5C, color ink is applied to the area 140 of the print zone 114 that previously was pretreated in the single pass illustrated in FIG. 5A.

In general, the physical gap 120 is adjusted by changing the swath height through the print mask such that the swath height and the media advance distance are full multiples of the effective gap. In FIG. 5, where the typical print mode upon which the physical gap 120 is based has more passes than the current print mode, the physical gap matches the advance distance (advance is 1× the effective gap 121) and the total swath height is 2× the effective gap 121. For situations where the current print mode has more passes than the typical print mode, the effective gap is set to a higher multiple of the print mode advance since the physical gap 120 cannot be made smaller through masking.

The effective gap and the associated number of nozzles to be masked for the example illustrated in FIG. 5 can be computed as follows. In FIG. 5, x and y designate the portions of the color ink printhead 102 and the fixer fluid printhead 101 to be masked, respectively. $G_a$ is the actual physical gap 120, $G_e$ is the effective gap 121, $S_a$ is the actual swath height based on the entire nozzle array of the color printheads 102, $S_e$ is the desired effective swath height after masking the printheads 102, $F_a$ is the actual height of the fixer fluid printhead 101 based on the entire nozzle array of the printhead 101, $F_e$ is the effective fixer fluid printhead height after masking the printhead 101, and P is the number of passes in the current print mode.

As illustrated in FIG. 5, the effective gap $G_e$ is the actual physical gap $G_a$ together with the masked portions x, y of the printheads 101, 102. Further, the effective gap $G_e$ matches the advance distance, which is based on the effective swath height $S_e$ divided by the number of passes in the current print mode.

$$x+y+G_a=G_e=S_e/P$$

The effective swath height $S_e$ is the actual swath height $S_a$ less the masked portion of the printhead 102.

$$S_e=S_a-x$$

The desired effective height of the fixer fluid printhead $F_e$ is half the effective swath height $$S_e/2=F_e-y$$

Therefore, $$x=2y$$

$$S_e=\frac{P}{\left(1+\frac{3P}{2}\right)}\cdot\left[\frac{3\cdot S_a}{2}+G_a\right]$$

$$x=S_a-S_e$$

$$y=F_a-S_e/2$$

Thus, for the two-pass current print mode situation illustrated in FIG. 5, x is 1.4 inches, so the color ink printhead 102 is masked such that nozzles in the 1.4 inches of the printhead 102 adjacent the gap 120 do not apply ink, establishing an effective swath height of 7 inches. Further, y is 0.7 inches, resulting in an effective gap of 3.5 inches.

Although specific implementations have been illustrated and described herein, it will be appreciated by those of ordinary skill in the art that a variety of alternate and/or equivalent implementations may be substituted without departing from the scope of the present invention. For example, other implementations are envisioned in which the fixer fluid is applied as an overcoat rather than a pretreatment. This application is intended to cover any adaptations or variations of the specific disclosures discussed herein. Therefore, it is intended that this invention be limited only by the claims and the equivalents thereof.

What is claimed is:

1. A printing system, comprising:

first and second printheads spaced apart so as to define a gap between the first and second printheads;

a controller configured to control the printheads, including establishing a swath height of the second printhead based on the gap.

2. The printing system of claim 1, wherein:

the first printhead is a fixer fluid printhead; and the second printhead is a color ink printhead.

3. The printing system of claim 2, wherein:

the second printhead comprises a plurality of color ink printheads.

4. The printing system of claim 1, wherein:

the first and second printheads each include a plurality of nozzles; and establishing the swath height includes masking at least one of the first and second printheads such that nozzles adjacent the gap are not used to apply fluid from the respective printhead.

5. The printing system of claim 4, wherein:

the gap and the masked portions of the first and second printheads define an effective gap between the first and second printheads.

6. The printing system of claim 5, further comprising:

a carriage supporting the first and second printheads for movement along a first axis; and a media advance device configured to move a print medium along a second axis that is perpendicular to the first axis;

wherein the controller is configured to provide control signals to the media advance device to selectively move the print medium on the second axis by a predetermined advance distance;

wherein the advance distance equals the effective gap.

7. The printing system of claim 1, further comprising:

a carriage supporting the first and second printheads for movement along a first axis; and wherein the controller is configured to establish the swath height of the second printhead further based on a desired number of passes of the carriage along the first axis.

8. A printing method, comprising:

providing first and second printheads spaced apart so as to define a gap between the first and second printheads;

establishing a swath height of the second printhead based on the gap.

9. The printing method of claim 8, wherein:

the first printhead is a fixer fluid printhead; and the second printhead is a color ink printhead.

10. The printing method of claim 8, wherein:

the first and second printheads each include a plurality of nozzles, and wherein the method further includes masking at least one of the first and second printheads such that nozzles adjacent the gap are not used to apply fluid from the respective printhead.

11. The printing method of claim 10, wherein:

the gap and the masked portions of the first and second printheads define an effective gap between the first and second printheads.

12. The printing method of claim 11, further comprising:

selectively moving a carriage supporting the first and second printheads along a first axis;

selectively moving a print medium a predetermined advance distance along a second axis that is perpendicular to the first axis;

wherein the advance distance equals the effective gap.

13. The printing method of claim 12, further comprising:

moving the carriage along the first axis while applying a fixer fluid from the first printhead to a printing area of the print medium;

moving the print medium the predetermined advance distance along the second axis in a first advance;

moving the carriage along the first axis and not applying a fixer fluid from the first printhead to the printing area of the print medium;

moving the print medium the predetermined advance distance along the second axis in a second advance; and moving the carriage along the first axis while applying a colored ink from the second printhead to the printing area.

14. The printing method of claim 8, further comprising:

applying a fixer fluid from the first printhead to a printing area of a print medium;

applying a colored ink from the second printhead to the printing area.

15. A tangible machine readable storage medium storing instructions that when executed implement a method, comprising:

establishing a swath height of a second printhead based on a gap defined by a first printhead spaced apart from the second printhead.

* * * * *